US006082822A

United States Patent [19]

Kelly et al.

[11] Patent Number: 6,082,822

[45] Date of Patent: Jul. 4, 2000

[54] FURNITURE LEG ATTACHMENT SYSTEM AND METHOD, AND FURNITURE PRODUCED THEREBY

[75] Inventors: Ray G. Kelly, Kirkwood, Mo.; Olaf W. Mjelde, Valley Center; Joseph J. McRoskey, Solana Beach, both of Calif.

[73] Assignee: Angeles Group, Inc., Pacific, Mo.

[21] Appl. No.: 09/335,653

[22] Filed: Jun. 18, 1999

[51] Int. Cl.[7] ..... A47C 1/12

[52] U.S. Cl. ..... 297/448.1; 248/451.11; 248/440.13

[58] Field of Search ..... 297/448.1, 440.1, 297/440.13, DIG. 2, 451.11, 445.1, 452.18, 232, 248; 403/341, 364, 289, 298, 292, 381; 29/428; 108/158.12

[56] References Cited

U.S. PATENT DOCUMENTS

| | | | |
|---|---|---|---|
| D. 236,670 | 9/1975 | Uyeda | D6/66 |
| D. 239,345 | 3/1976 | Keller | D6/26 |
| D. 340,812 | 11/1993 | Estomin et al. | D6/334 |
| D. 346,281 | 4/1994 | Vidal | D6/370 |
| D. 347,741 | 6/1994 | Vidal | D6/370 |
| 3,031,227 | 4/1962 | Van Buren | 297/239 |
| 3,669,496 | 6/1972 | Chisholm | 297/445 |
| 3,695,702 | 10/1972 | Ingellis | 297/441 |
| 3,698,150 | 10/1972 | Anderson | 52/731 |
| 3,873,154 | 3/1975 | Baker | 297/445 |
| 4,609,225 | 9/1986 | Loucks | 297/440 |
| 4,691,965 | 9/1987 | Hsiung . | |
| 4,904,022 | 2/1990 | Morozzi . | |
| 5,071,191 | 12/1991 | Leib | 297/445 |
| 5,094,507 | 3/1992 | Gibbs | 297/239 |
| 5,499,883 | 3/1996 | Heinzel . | |
| 5,599,068 | 2/1997 | Kelly et al. | 297/448.1 |

*Primary Examiner*—Milton Nelson, Jr.
*Attorney, Agent, or Firm*—Woodard, Emhardt, Naughton, Moriarty & McNett, Patent and Trademark Attorneys

[57] ABSTRACT

A novel furniture leg attachment system is provided for attaching legs to articles of furniture, for example chairs. In one embodiment, a furniture member, such as a seat, is provided which defines a slot and a fastener first bore intersecting the slot. The leg member has a tab received within the slot. The tab defines a fastener second bore which is aligned with the fastener first bore when the tab is correctly received within the slot. A fastener is inserted through the fastener first bore and the fastener second bore to retain the tab within the slot. In alternate embodiments, the leg member may have two, three or more tabs, sized and shaped to fit within corresponding slots in the furniture member. In one embodiment, a smooth fastener such as a peg is used to retain the tabs within the slots, allowing easy assembly. Locking means device may be included to retain the fastener in place and to make disassembly difficult.

25 Claims, 8 Drawing Sheets

FURNITURE LEG ATTACHMENT SYSTEM AND METHOD, AND FURNITURE PRODUCED THEREBY

FIELD OF THE INVENTION

This invention relates generally to furniture, and to a system and method for attaching legs to articles of furniture. The system is particularly useful in connection with children's furniture.

BACKGROUND OF THE INVENTION

Traditional furniture, for example chairs, often includes legs which form a base to support the furniture. Typically, these legs are made from metal, wood or plastic and are attached with screws, bolts, rivets, welding or in similar manners. When pre-assembled, packing such furniture for shipping requires wasted space in the areas between the legs, leading to excess cost. Alternatively, if the furniture is shipped unassembled, assembly upon arrival frequently requires extra time and tools not always available at the destination.

Most methods of attaching furniture legs require the use of screws, bolts or similar fasteners with protruding rough edges. Especially when used in children's furniture, a child may be cut or scraped by a protruding rough edge. Furthermore, many teachers and parents have difficulty with children removing screws, bolts, or nuts, disassembling the articles of furniture and losing or swallowing the small pieces. Adult furniture may have similar problems with rough edges or lost parts.

Consequently, there is a need for a furniture leg attachment system which minimizes wasted space in packing and shipping, is simple to assemble without tools, minimizes rough edges, and is difficult to disassemble.

It is also desirable to have children's furniture which is both functional and aesthetic. Such furniture needs to be sturdy and rugged to endure the rough treatment which it may receive. It should also be lightweight to be readily handled by children. From a design standpoint, children's furniture should not simply be reduced versions of adult furniture. First, children are not proportioned the same as adults, and the furniture should take this into account. Second, children are attracted to different designs. The present invention provides a furniture design which combines all of these attributes.

SUMMARY OF THE INVENTION

According to preferred embodiments of the present invention, a novel furniture leg attachment system is provided for attaching legs to articles of furniture, for example chairs. In one embodiment a furniture leg attachment system includes a furniture member having first and second leg mounting locations along each side. The furniture member defines a first slot in the first mounting location and a second slot in the second mounting location, and further defines first and second fastener bores intersecting the first and second slots, respectively. The system further includes a leg member having first and second portions formed to serve as leg elements for the furniture member. A first tab extends from the first leg portion and is received in the first slot in the first mounting location. The first tab defines a third fastener bore aligned with the first fastener bore when the first tab is received within the slot. A second tab extends from the second leg portion and is received in the second slot in the second mounting location. The second tab defines a fourth fastener bore aligned with the second fastener bore when the second tab is received within the second slot. A first fastener extends through the first and third fastener bores to retain the first tab within the first slot and a second fastener extends through the second and fourth fastener bores to retain the second tab within the second slot.

In an alternate embodiment, at least one slot is defined in the furniture member and a first bore is defined perpendicular to and intersecting the at least one slot. The leg member to be attached has at least one tab sized and shaped to fit within the slot. The tab defines a second bore which is aligned with the first bore when the tab is positioned within the slot. A fastener is received through the first bore and the second bore to retain the tab within the slot. In alternate embodiments, the leg member may have two, three or more tabs, sized and shaped to fit within corresponding slots in the furniture member. In one embodiment, a smooth fastener such as a peg is used to retain the tab(s) within the slot(s), allowing easy assembly. Locking means may be included to retain the fastener in place and to make disassembly difficult.

Accordingly, it is an object of the invention to provide an improved furniture leg attachment system and method.

It is a further object of a preferred embodiment of the present invention to provide a furniture leg attachment system which is easy to assemble, has a minimum of exposed rough edges, and is difficult to disassemble.

Further objects, features and advantages of the present invention will become apparent from the detailed drawings and descriptions provided herein.

DESCRIPTION OF THE PREFERRED EMBODIMENTS

For the purposes of promoting an understanding of the principles of the invention, reference will now be made to the embodiments illustrated and specific language will be used to describe the same. It will nevertheless be understood that no limitation of the scope of the invention is thereby intended, such alterations, modifications, and further applications of the principles of the invention being contemplated as would normally occur to one skilled in the art to which the invention relates.

The furniture leg attachment system and method of the present invention are designed to allow easier and more efficient packaging, shipping and assembly of furniture while providing a secure connection between the furniture article and its legs. Preferred embodiments of the invention include chairs, stools or benches, particularly for children, although also contemplated are other articles of furniture having attached legs. Through the present invention, leg members may be packed and shipped disassembled from the articles of furniture to more efficiently utilize space and accordingly reduce total and per piece shipping costs. Furthermore, upon arrival, the furniture articles and leg members may be securely fastened together quickly and easily without the use of tools which may not be conveniently present. After assembly, the furniture leg attachment preferably has smooth edges to avoid cuts, scrapes or other injuries to users, and also is difficult to disassemble.

Figure 1:
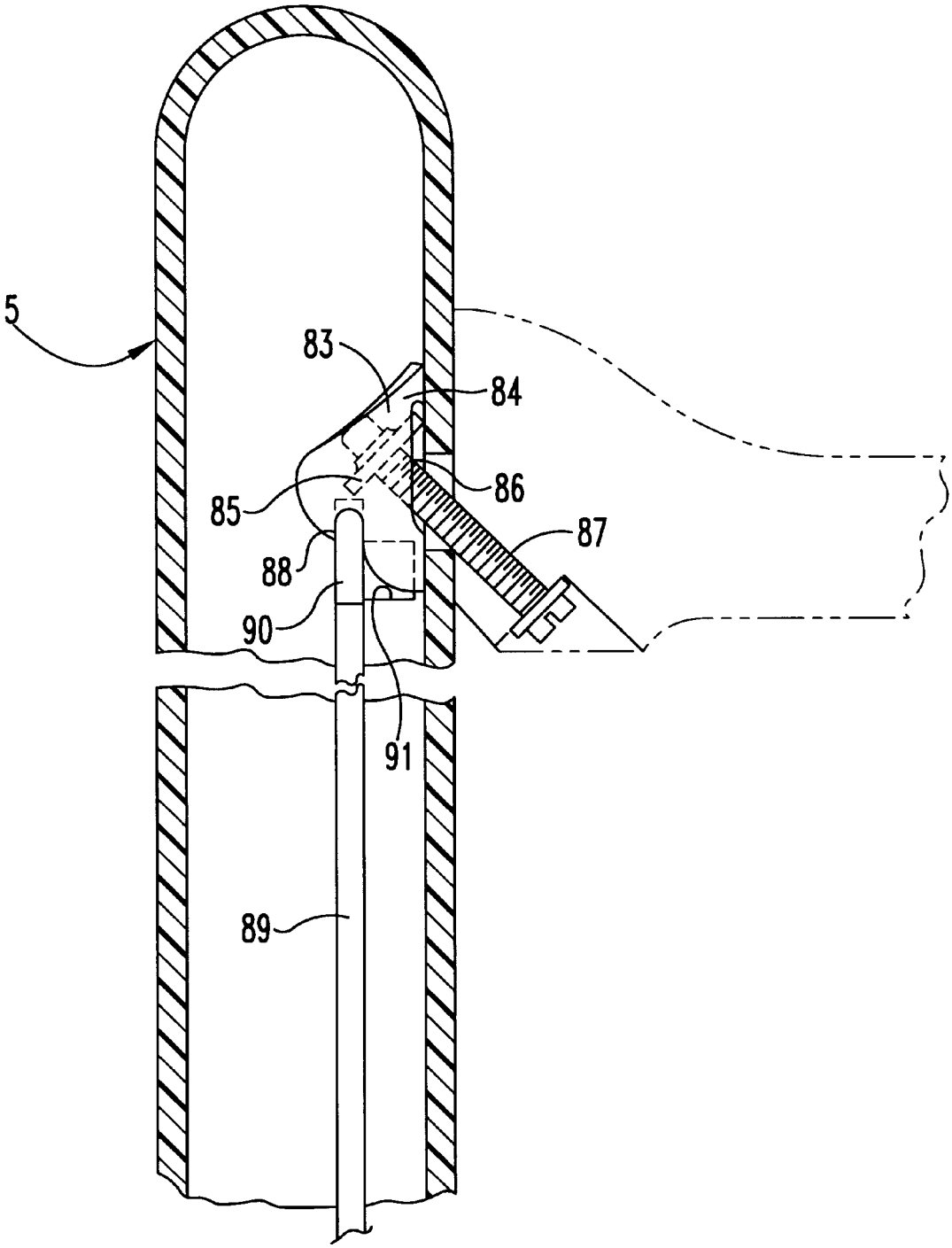
Fig. 1 (Prior Art)
FIG. 1 is an illustration of an attachment system in the prior art.

A prior art leg attachment system is illustrated in FIG. 1. It is also illustrated in U.S. Pat. No. 5,599,068 hereby incorporated by reference. As shown, the prior art system used a threaded screw or bolt which was slanted to extend through a portion of the furniture member and into the leg, and which was sometimes received in a nut or washer. A screwdriver, wrench or other tools are needed to insert and tighten the screw or bolt, and the screw or bolt has the potential to become loose, disassembled and lost with use and time. Furthermore, it is often difficult to insert the nut or washer into the leg and correctly align and thread it with the screw or bolt.

Figure 2:
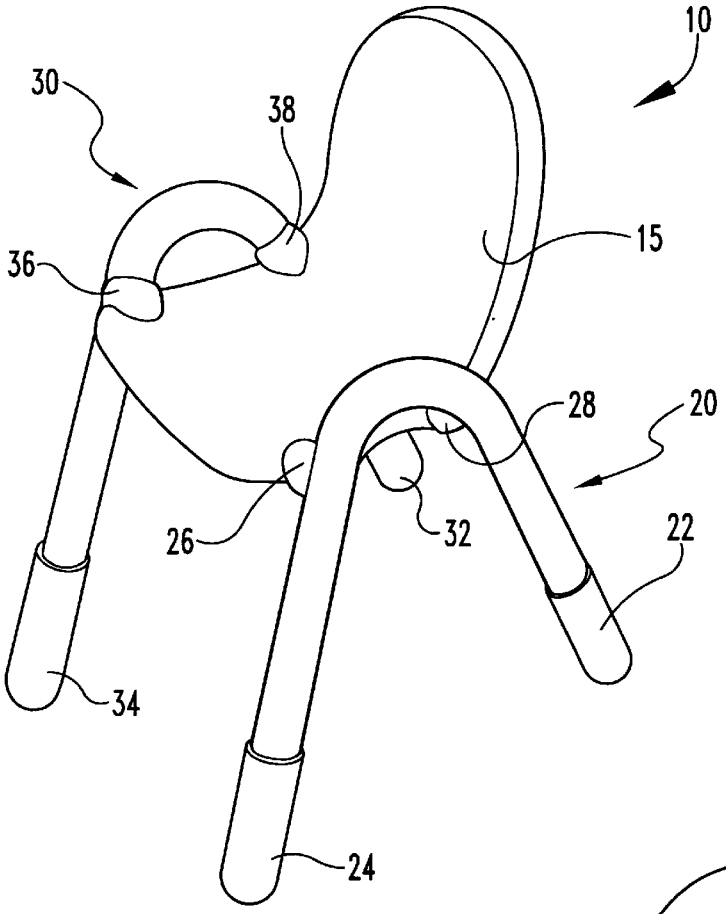
FIG. 2 is a perspective view of one embodiment of an article of furniture according to the present invention.
Figure 3:
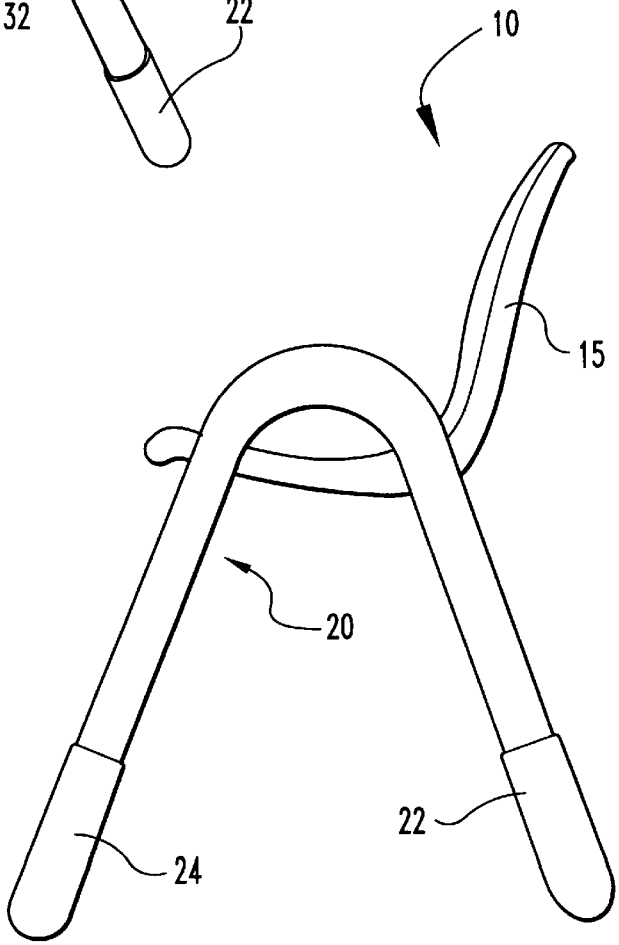
FIG. 3 is a side view of the article of furniture of FIG. 2.

The present invention provides a furniture assembly system which overcomes the problems of the prior art. As shown in FIGS. 2 and 3, the present invention may comprise a furniture member 10 including chair seat 15 and leg members 20 and 30. A chair is illustrated by way of example, but it will be understood that the leg attachment may be modified for various other articles of furniture. As shown, each leg member 20 and 30 includes two leg elements 22, 24 and 32, 34, respectively, forming the base of furniture article 10. Leg members 20 and 30 are attached to chair seat 15 at first mounting locations 26 and 36 and second mounting locations 28 and 38, respectively. In particular, the invention forms a chair having tabs extending from the leg members and interdigitating with slots in the chair seat. A peg or other fastener extends through a bore having an opening in the lower surface of furniture article 10 which intersects the tabs and slots. Preferably the fastener locks in place to form a secure connection and to impede removal.

Figure 4:
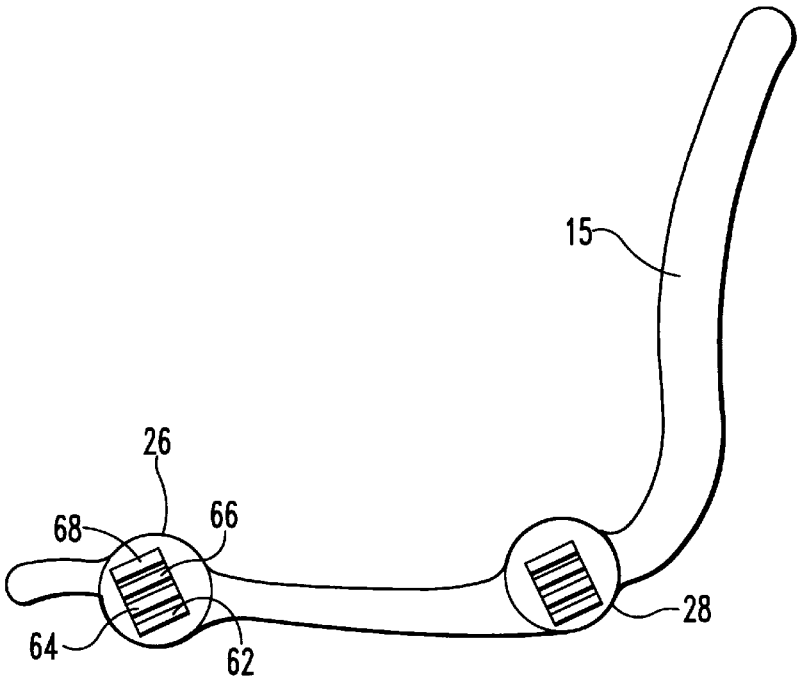
FIG. 4 is a side view of one embodiment of a furniture member useful with the present invention.
Figure 5:
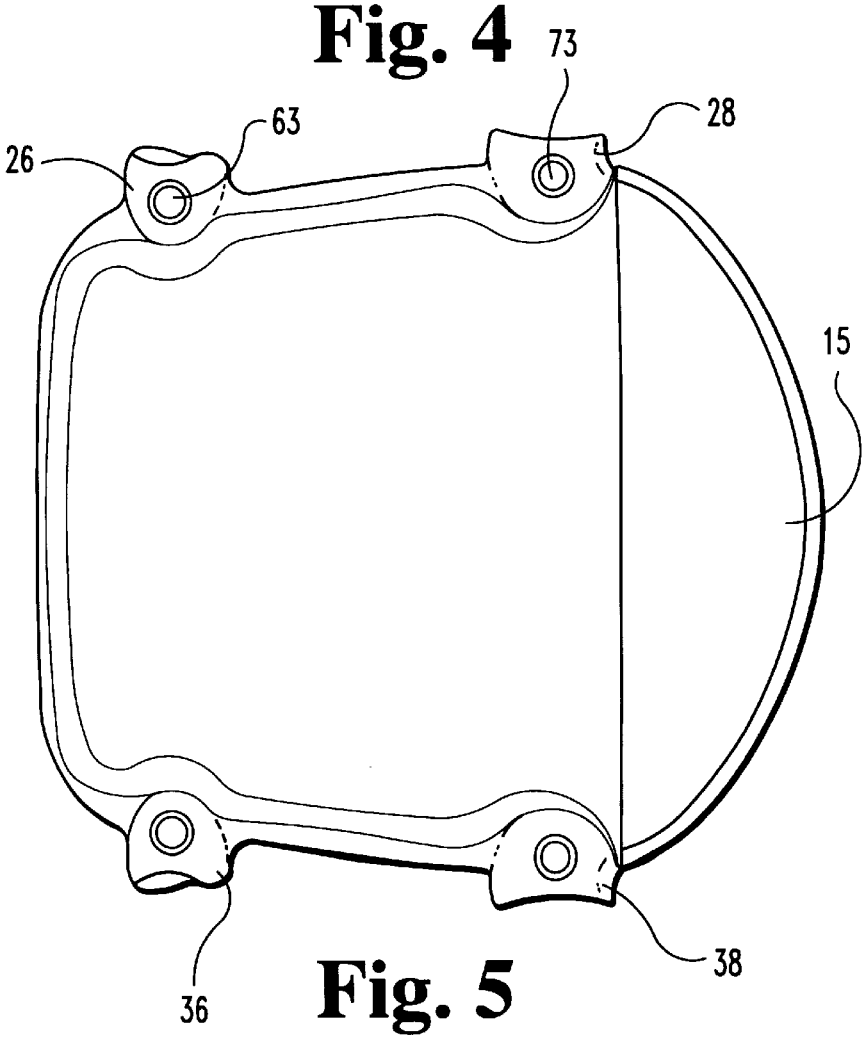
FIG. 5 is a bottom view of the furniture member of FIG. 4.
Figure 6:
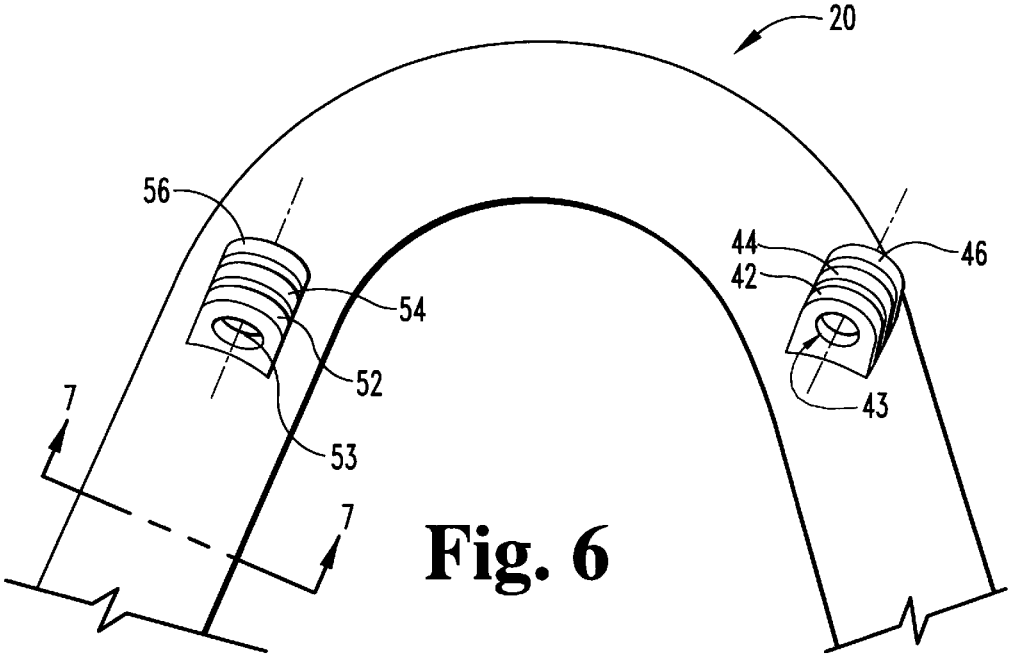
FIG. 6 is a detail, side view of one embodiment of a leg member used with the present invention.

FIGS. 4 and 5 illustrate side and bottom views of chair seat 15. The edge of chair seat 15 includes slots or recesses 62, 64 and 66 at first mounting location 26 sized and shaped to receive tabs 42, 44 and 46 on leg member 20 (FIG. 6). Similarly, second mounting location 28 along the edge of chair seat 15 includes slots to receive corresponding tabs 52, 54 and 56 on leg member 20. A locking opening 68 is additionally provided to receive the locking means of fastener 70 (described below). As shown in FIG. 5, first mounting location 26 includes a preformed fastener first bore 63 opening upwardly from the lower surface of chair seat 15, perpendicular to and intersecting slots 62, 64 and 66 and space 68. Preformed fastener second bore 73 is similarly located in second mounting location 28. In one embodiment, the mounting locations are bosses to provide additional strength.

The slots in first and second mounting locations 26 and 28 are shown in parallel and illustrate three slots and space 68. The slots are sized and shaped to receive the tabs on leg member 20 and locking opening 68 provides room for locking means 78. It will be understood that the number and direction of the slots and tabs may be varied so long as there are a sufficient number of slots for tabs and sufficient structural strength is provided for the furniture article.

Figure 7:
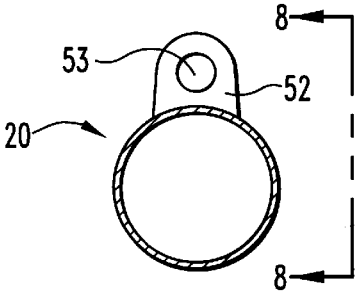
FIG. 7 is a cross-sectional view of the leg member of FIG. 6 taken along the line 7—7 and viewed in the direction of the arrows.
Figure 8:
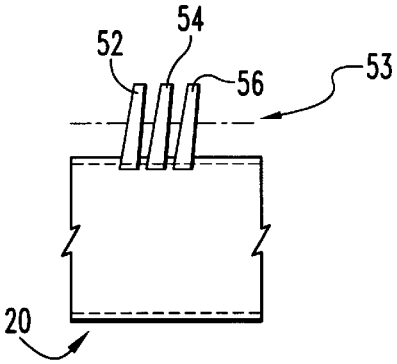
FIG. 8 is a partial side view of the leg member of FIG. 7 taken along the line 8—8 and viewed in the direction of the arrows.

With reference to FIGS. 6–8, leg member 20 defines a first longitudinal axis with at least first tab 42 extending from leg member 20 perpendicular to the axis. Tab 42 defines fastener bore 43, preferably perpendicular to tab 42. In one embodiment, three parallel tabs 42, 44 and 46 extend from leg member 20 wherein fastener bore 43 intersects tabs 42, 44 and 46. Leg member 20 also preferably includes a second set of parallel tabs 52, 54 and 56 perpendicular to a second longitudinal axis situated to correspond to second mounting location 28 and defining fastener bore 53. The tabs can be molded directly onto the legs or alternately formed on a separate piece which is then grafted onto the leg elements.

Cross-sectional views of leg member 20 including tabs 52, 54 and 56 are shown in FIG. 7 taken along line 7—7 of FIG. 6, and FIG. 8 taken along line 8—8 of FIG. 7. Tabs 42 and 52 could be round, square, rectangular or other shapes and can be of various thicknesses. In an alternate embodiment, leg member 20 includes only one leg element. Leg member 30 is constructed in a mirror image to leg member 20.

In one embodiment, each leg member 20 and 30 includes two leg elements 22, 24 and 32, 34, respectively. The leg elements form the base of the piece of furniture. By combining pairs of leg elements in each leg member, additional stability is added to the article of furniture and stability is added to the attachment of the leg member to the chair seat. For example, with the leg member attached to the chair seat in two places, torque or twist on the leg is minimized, thus further protecting the leg connection. In one embodiment, the corresponding leg elements are connected with an arcuate curve extending above the seat, providing a smooth connection and additional strength and stability. Optionally the upwardly extending portions of the leg elements can be configured as armrests or as guides for stacking articles the furniture.

Figure 9B:
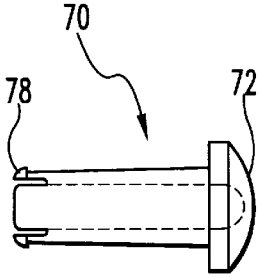
FIGS. 9A, 9B and 9C are three views of one embodiment of a fastener useful with the present invention.
Figure 9A:
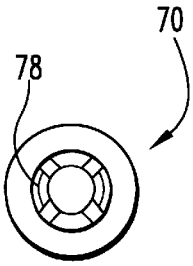
Figure 9C:
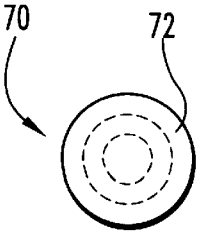

Fastener 70 is illustrated in FIGS. 9A, 9B and 9C. As shown, fastener 70 is a peg with head 72 and protuberances 78 formed on fingers extending from the distal end to form a locking means. In one embodiment, protuberances 78 are biased to spring outward slightly to engage space 68, locking fastener 70 in place. Preferably, head 72 of fastener 70 has a substantially smooth surface without protrusions, slots, notches, holes or other rough edges. In one embodiment, head 72 is received slightly within an opening in the lower surface of chair seat 15 either at the same diameter as the bore or slightly larger than the diameter of the bore and received in a countersink.

In an alternate embodiment, fastener 70 and the fastener bores are inwardly tapered towards the distal end such that the fastener fits more tightly within the fastener bore the further the fastener is inserted. In a further alternate embodiment, fastener 70 is compressed during insertion and locked in place by frictional engagement with the surrounding material defining the fastener bores. In another embodiment the fastener could be threaded and have receiving threads in the fastener bore or a nut in locking opening 68. Although assembly without tools is preferred, head 72 could be slotted for a screwdriver or have a square or hexagonal shape.

Figure 10:
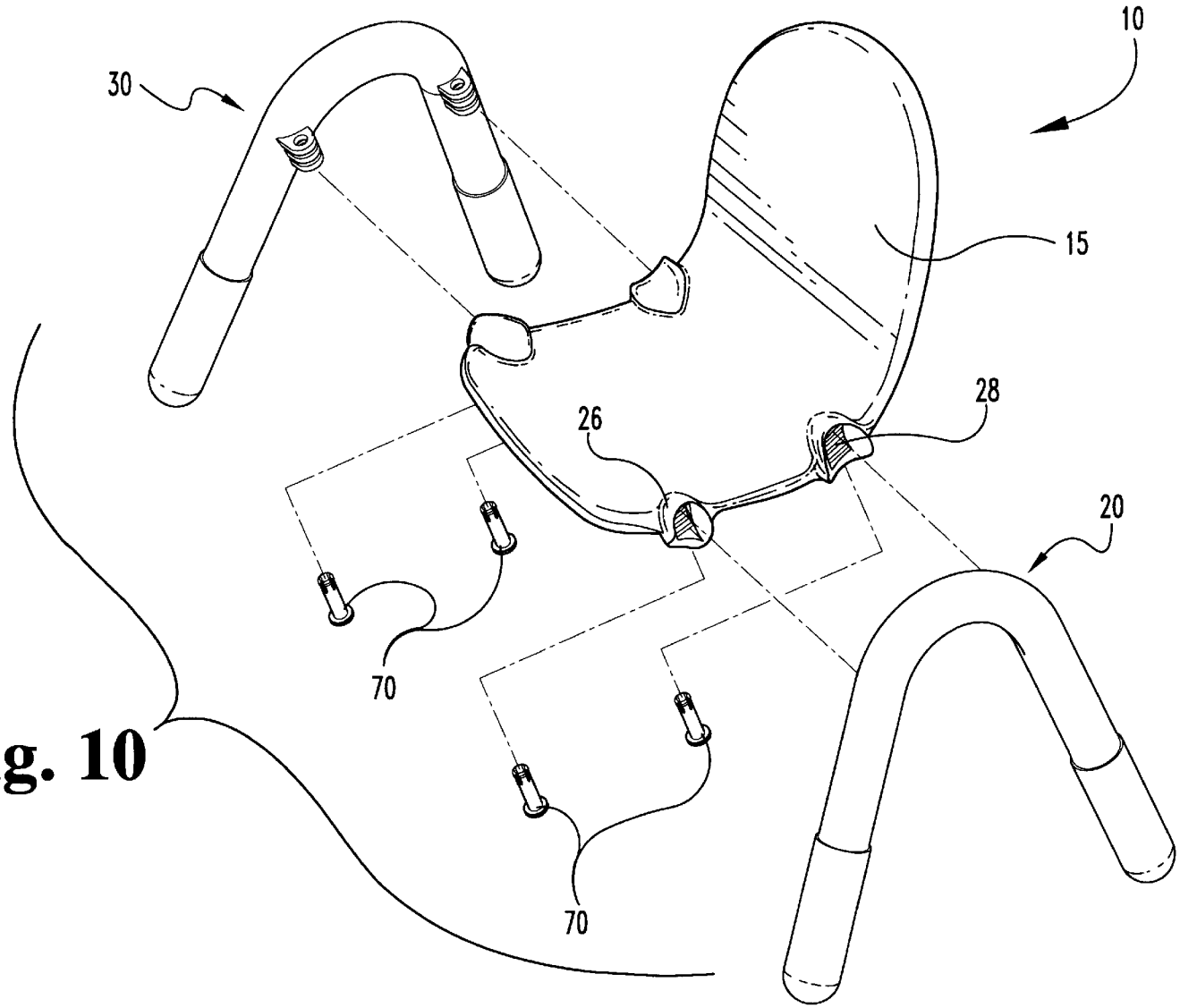
FIG. 10 is a diagrammatical view for assembly of the article of furniture of FIG. 2.
Figure 11:
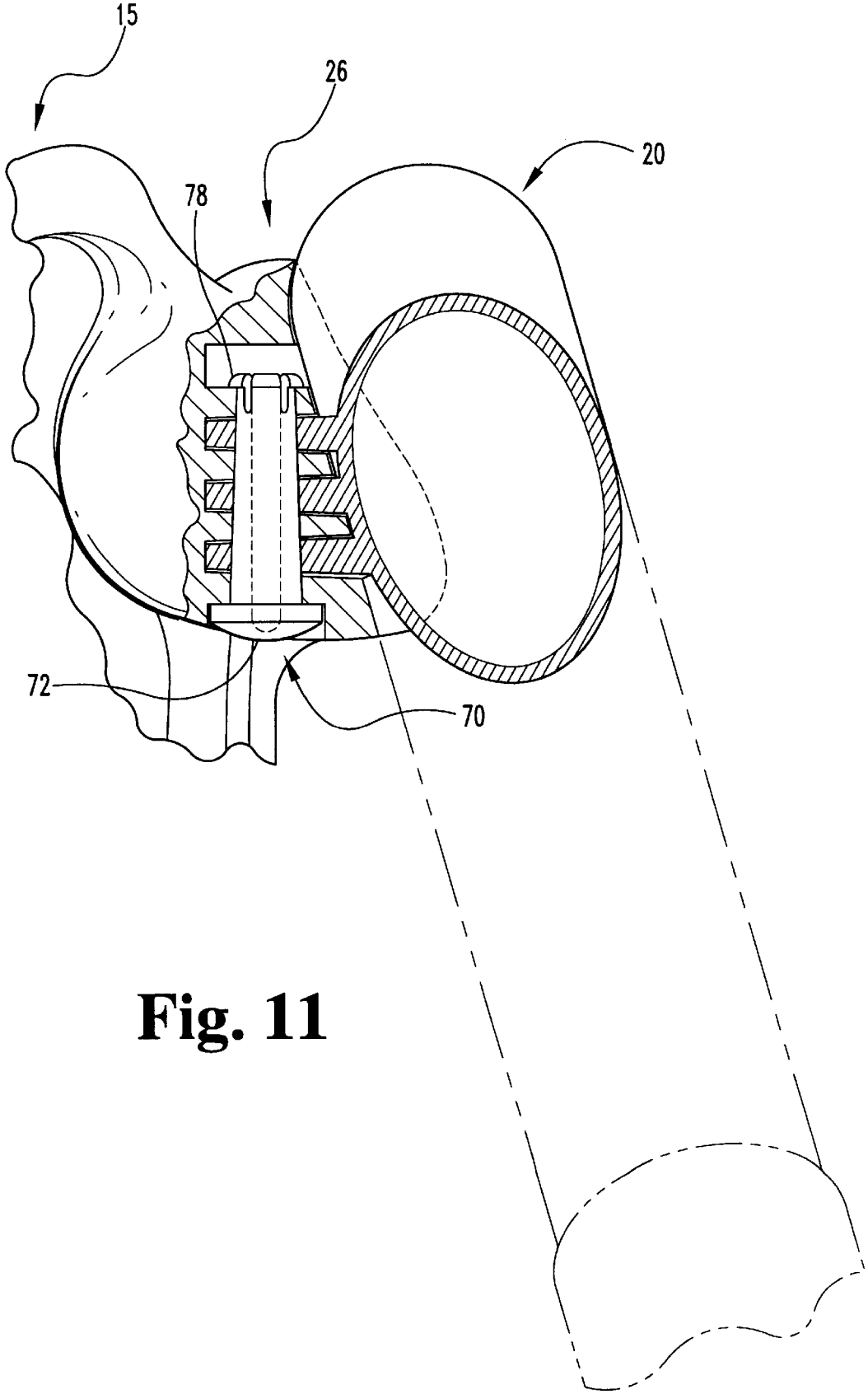
FIG. 11 is a cross-sectional, angled view for assembly of the article of furniture of FIG. 2.

Assembly of furniture article 10 is diagrammed in FIGS. 10 and 11. Chair seat 15 is situated with respect to leg member 20. The tabs on leg member 20 are inserted into the corresponding slots in first and second mounting locations 26 and 28 on the chair seat. When correctly in place, fastener bore 63 is aligned with fastener bore 43 and fastener bore 73 is aligned with fastener bore 53. Fasteners 70 are inserted through the bores in mounting locations 26 and 28 to retain the tabs within the slots, thus securing leg member 20 to the chair seat. Preferably, fasteners 70 are inserted using hand pressure or a slight tapping. Leg member 30 is similarly secured. Leg members 20 and 30 are preferably angled from vertical in a range from about two degrees to about nine degrees, most preferably around two degrees.

Figure 12:
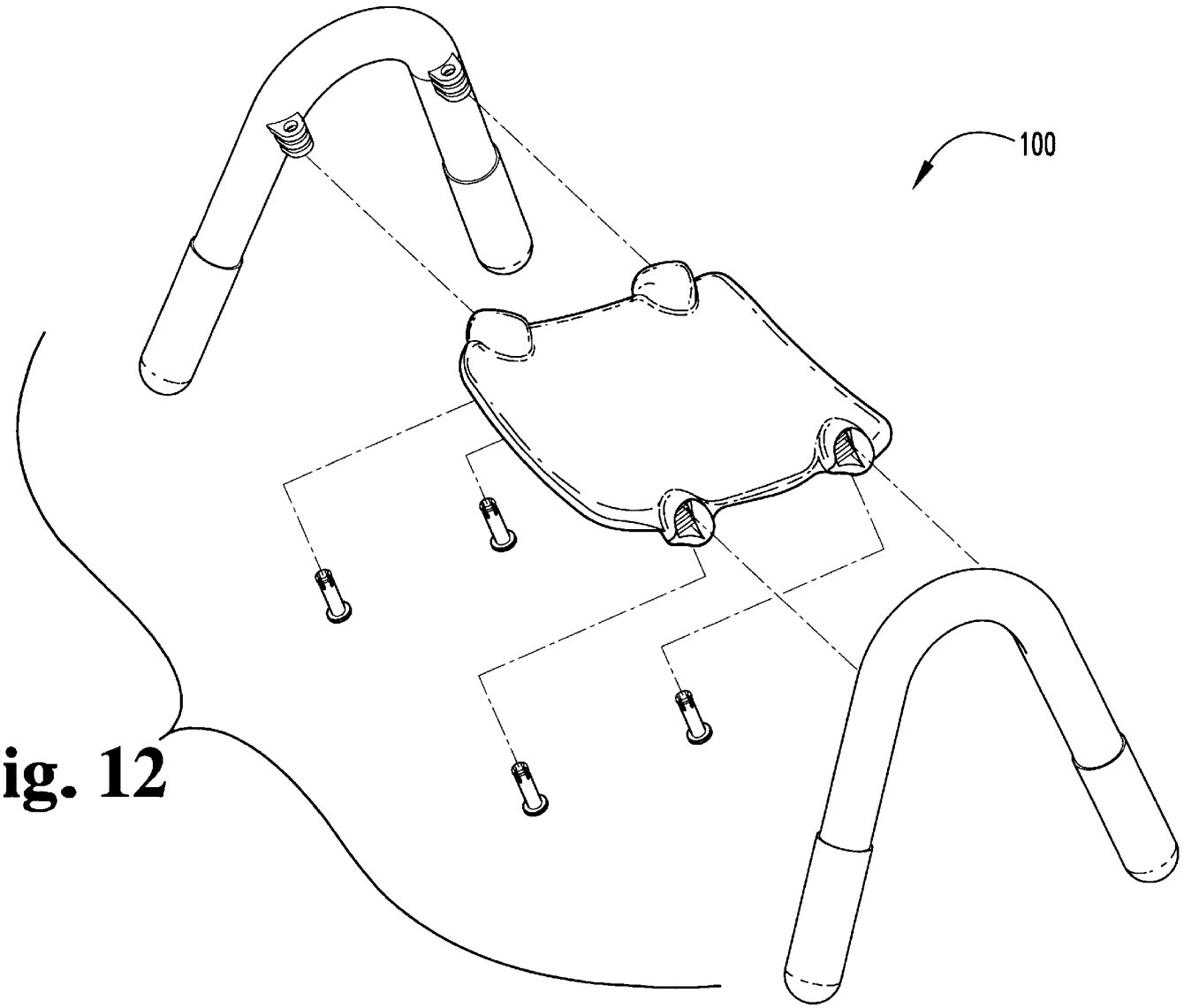
FIG. 12 is an assembly drawing for an alternate embodiment of the present invention.
Figure 13:
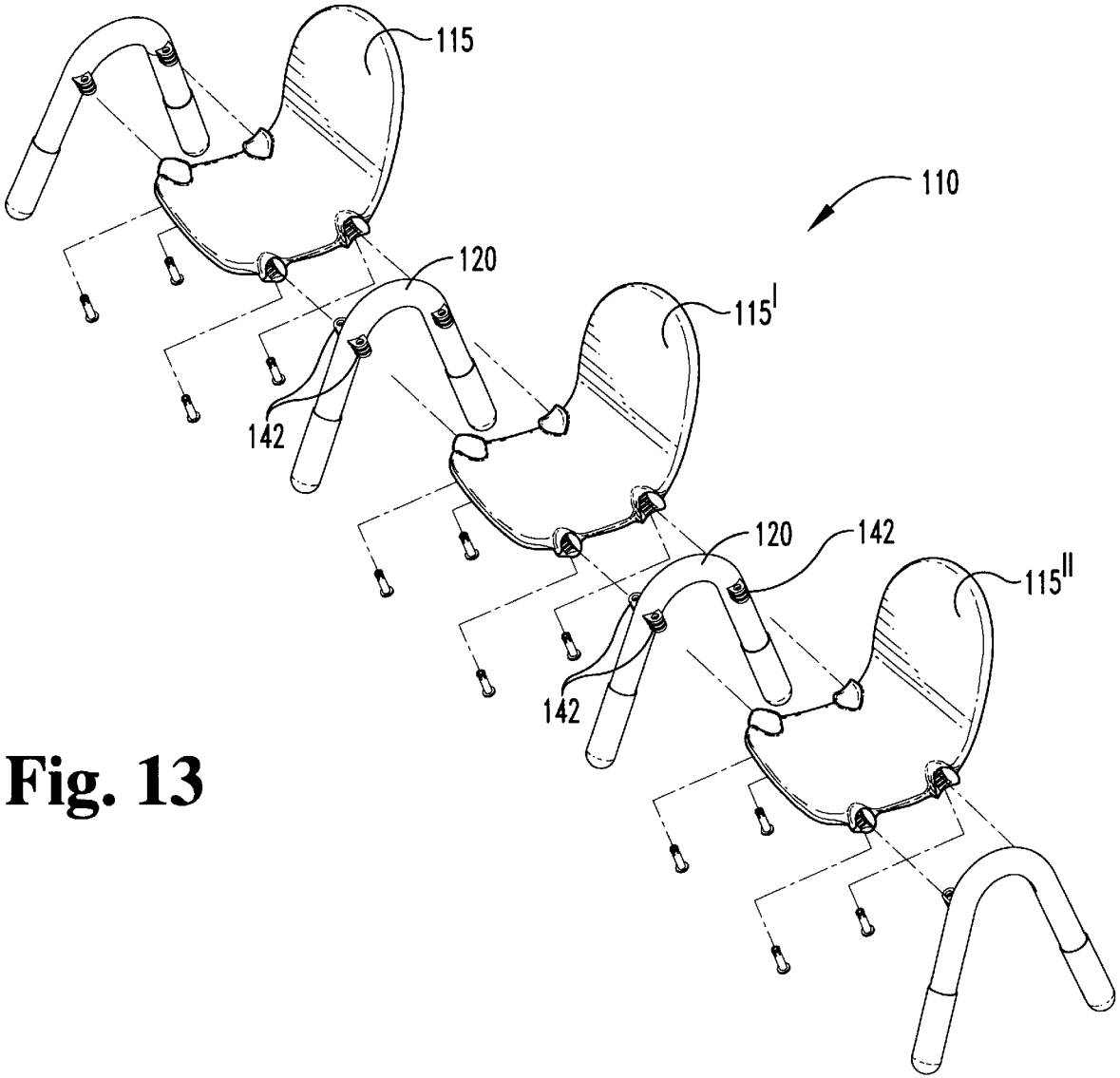
FIG. 13 is an assembly drawing for a further alternate embodiment of the present invention.

Alternate embodiments are illustrated in FIGS. 12 and 13. FIG. 12 is a stool 100 having leg members attached according to the present invention. Multi-seat bench 110 is demonstrated in FIG. 13. In multi-seat bench 110, leg members 120 have tabs 142 on opposing sides to engage corresponding slots on separate furniture members such as chair seats 115 and 115' or 115' and 115".

The present invention is useful for a wide variety of articles of furniture. In one embodiment, the present invention is used with seats or chairs sized particularly for children. In alternate embodiments, the leg attachment system may be used with adult or child sized chairs, stools, benches or similar furniture. For example, the chair seat could be a seat which is backless or could be solid, cutout, perforated, framed for fabric, or other designs as would be understood in the art. For ease in handling, the furniture member with slots, the legs with tabs and the fasteners are lightweight. The chair seat may be made from co-injection plastic with outer skin, such as polypropylene, molded over a foamed co-injected inner material, such as polyethylene. Alternate materials and methods could be injection molded plastic, wound filaments or prepreg sheets in resin, blow molded plastic, wood, metal or similar known furniture materials. In an alternate embodiment, for additional strength or ease in manufacture, the tabs may be formed on a separate piece. Although appropriate sizes need to be maintained for structural strength, the furniture leg attachment system is independent of the size or type of furniture.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A furniture leg attachment system, comprising:

a) a furniture member having along one side at least first and second leg mounting locations, said furniture member defining a first slot in said first mounting location and a second slot in said second mounting location, and said furniture member defining a first preformed fastener bore intersecting the first slot and a second preformed fastener bore intersecting the second slot;

b) a leg member having first and second portions formed to serve as leg elements for said furniture member, said leg member including a first tab extending from the first leg portion and received in the first slot in said first mounting location, the first tab defining a third fastener bore aligned with the first fastener bore when the first tab is received within the first slot, said leg member further including a second tab extending from the second leg portion and received in the second slot in said second mounting location, the second tab defining a fourth fastener bore aligned with the second fastener bore when the second tab is received within the second slot;

c) a first fastener extending through the first and third fastener bores to retain the first tab within the first slot in said first mounting location; and, d) a second fastener extending through the second and fourth fastener bores to retain the second tab within the second slot in said second mounting location.

2. The furniture leg attachment system of claim 1 wherein said furniture member defines a plurality of slots in said first mounting location, the fastener first bore extending through and communicating with each of said slots, and wherein said first leg portion has a corresponding plurality of tabs extending from said first leg portion, and received within the plurality of slots in said first mounting location, the third fastener bore extending through each of the tabs, and wherein said furniture member defines a plurality of slots in said second mounting location, the fastener second bore extending through and communicating with each of said slots, and wherein said second leg portion has a corresponding plurality of tabs extending from said second leg portion and received within the plurality of slots in said second mounting location, the fourth fastener bore extending through each of the tabs.

3. The furniture leg attachment system of claim 2 wherein the first fastener bore is perpendicular to the plurality of slots in said first mounting location and wherein the fastener second bore is perpendicular to the plurality of slots in said second mounting location.

4. The furniture leg attachment system of claim 3 wherein said first fastener and said second fastener include locking means to retain said first fastener in the first and third fastener bores and said second fastener in the second and fourth fastener bores.

5. The furniture leg attachment system of claim 4 wherein said locking means comprises protuberances on the distal ends of said first and second fasteners which are received within first and second locking openings defined in said first and second mounting locations adjacent to said first and second slots, and wherein said protuberances are biased to expand into the locking openings to impede removal of said first and second fasteners.

6. The furniture leg attachment system of claim 4 wherein said furniture member, said leg member and said first and second fasteners are formed of molded plastic.

7. The furniture leg attachment system of claim 6 wherein said furniture member includes a lower surface and the defined fastener first bore and fastener second bore define openings in said lower surface.

8. The furniture leg attachment system of claim 7 wherein said first and second fasteners include substantially smooth heads received within the openings in said lower surface of said furniture member.

9. The furniture leg attachment system of claim 4 wherein said furniture member is a chair seat.

10. The furniture leg attachment system of claim 9 wherein said first and second portions of said leg member are connected with an arcuate curve.

11. The furniture leg attachment system of claim 10 wherein said arcuate curve extends above said chair seat.

12. A furniture leg attachment system, comprising:

a) a furniture member having a lower surface and at least one side, wherein a slot is defined in said at least one side and wherein a fastener first bore is defined including an opening in said lower surface and intersecting the slot;

b) a leg member having a tab extending from said leg member and received within the slot, the tab defining a fastener second bore wherein the fastener first bore and the fastener second bore are aligned when the tab is within the slot; and, c) a fastener placed through the fastener first bore and the fastener second bore to retain the tab within the slot.

13. The furniture leg attachment system of claim 12 wherein said furniture member includes a plurality of slots defining the fastener first bore and wherein said leg member has a corresponding plurality of tabs extending from said leg member and defining the fastener second bore, wherein said tabs are received within the plurality of slots.

14. The furniture leg attachment system of claim 13 wherein said furniture member defines three parallel slots defining the fastener first bore and wherein said leg member has three corresponding parallel tabs defining the fastener second bore.

15. The furniture leg attachment system of claim 12 wherein said fastener has a smooth exterior surface.

16. The furniture leg attachment system of claim 15 wherein said fastener is a peg.

17. The furniture leg attachment system of claim 15 further comprising locking means to retain said fastener within the fastener first bore and the fastener second bore.

18. The furniture leg attachment system of claim 17 wherein said locking means comprises protuberances on the distal end of said fastener which are received within a locking opening defined in said furniture member adjacent to the slot, and wherein said protuberances are biased to expand into the locking opening to impede removal of said fastener.

19. The furniture leg attachment system of claim 18 wherein said furniture member, said leg member and said fastener are formed from plastic.

20. The furniture leg attachment system of claim 17 wherein said furniture member is a seat.

21. The furniture leg attachment system of claim 20 wherein said leg member extends above said seat.

22. A method for attaching a leg to an article of furniture, comprising the steps of:

a) providing an article of furniture, wherein said article of furniture has a lower surface and at least one side, wherein a slot is defined in said side and wherein a fastener first bore is defined intersecting the slot and including an opening in said lower surface;

b) providing a leg member having a tab extending from said leg member, wherein the tab defines a fastener second bore;

c) inserting the tab into the slot wherein upon insertion of the tab the fastener second bore is aligned with the fastener first bore; and, d) inserting a fastener through the opening in said lower surface into the fastener first bore and the fastener second bore to retain the tab within the slot.

23. The method of attaching a leg to an article of furniture of claim 22 wherein a plurality of parallel slots are defined in said side and define the fastener first bore, and wherein the leg member has a plurality of parallel tabs defining the fastener second bore and extend from said leg member, and the method comprises inserting the tabs into the plurality of parallel slots.

24. The method of attaching a leg to an article of furniture of claim 23 wherein said fastener is a peg.

25. The method of attaching a leg to an article of furniture of claim 22 further comprising the step of locking said fastener into place to retain the tab within the slot.

* * * * *

UNITED STATES PATENT AND TRADEMARK OFFICE

CERTIFICATE OF CORRECTION

PATENT NO. : 6,082,822

DATED : July 4, 2000

INVENTOR(S) : Ray G. Kelly et al.

It is certified that error appears in the above-identified patent and that said Letters Patent is hereby corrected as shown below:

On the front page of the patent, line 15 of the Abstract, please delete the word "means".

Signed and Sealed this

First Day of May, 2001

Nicholas P. Godici

*Attest:*

NICHOLAS P. GODICI

*Attesting Officer*

*Acting Director of the United States Patent and Trademark Office*